US006585141B2

(12) United States Patent
Goss et al.

(10) Patent No.: US 6,585,141 B2
(45) Date of Patent: Jul. 1, 2003

(54) ADJUSTABLE-LENGTH END PIECE FOR A FASTENER DRIVE TOOL

(75) Inventors: David C. Goss, Rockford, IL (US); Jordan Kingsbury, Lindenwood, IL (US)

(73) Assignee: Textron Inc., Providence, RI (US)

( * ) Notice: Subject to any disclaimer, the term of this patent is extended or adjusted under 35 U.S.C. 154(b) by 0 days.

(21) Appl. No.: 09/908,257

(22) Filed: Jul. 18, 2001

(65) Prior Publication Data

US 2002/0040797 A1 Apr. 11, 2002

Related U.S. Application Data

(63) Continuation-in-part of application No. 09/815,809, filed on Mar. 23, 2001, which is a continuation-in-part of application No. 09/680,761, filed on Oct. 6, 2000, now Pat. No. 6,296,064.

(60) Provisional application No. 60/192,866, filed on Mar. 29, 2000, and provisional application No. 60/173,347, filed on Dec. 28, 1999.

(51) Int. Cl.[7] ..... B27B 17/00

(52) U.S. Cl. ..... 227/109; 227/119; 227/142; 173/30

(58) Field of Search ..... 227/109, 119, 227/136, 142, 147, 149; 173/30, 18, 170

(56) References Cited

U.S. PATENT DOCUMENTS

| | | | | | |
|---|---|---|---|---|---|
| 2,723,835 | A | | 11/1955 | Reese et al. | |
| 3,746,235 | A | * | 7/1973 | Crabtree, Jr. | 227/142 |
| 3,788,537 | A | * | 1/1974 | Fox | 227/142 |
| 3,802,517 | A | | 4/1974 | Cooke-Yarborough | |
| 3,960,191 | A | | 6/1976 | Murray | |
| 4,236,555 | A | | 12/1980 | Dewey | |
| 4,246,939 | A | | 1/1981 | Boegel | |
| 4,354,403 | A | | 10/1982 | Boegel et al. | |
| 4,397,412 | A | | 8/1983 | Dewey | |
| 4,402,369 | A | | 9/1983 | Nikitin et al. | |
| 5,199,625 | A | | 4/1993 | Dewey et al. | |
| 5,605,423 | A | | 2/1997 | Janusz | |
| 5,897,043 | A | * | 4/1999 | Veoukas et al. | 227/142 |
| 5,897,045 | A | | 4/1999 | Olvera et al. | |
| 5,921,454 | A | | 7/1999 | Larson et al. | |
| 6,145,727 | A | * | 11/2000 | Mukoyama et al. | 227/142 |
| 6,209,770 | B1 | * | 4/2001 | Perra | 227/142 |
| 6,296,064 | B1 | * | 10/2001 | Janusz et al. | 173/30 |

* cited by examiner

*Primary Examiner*—Scott A. Smith
(74) *Attorney, Agent, or Firm*—Trexler, Bushnell, Giangiorgi, Blackstone & Marr, Ltd.

(57) ABSTRACT

An adjustable end piece engagable with a drive tool and configured to deliver fasteners from the drive tool to a work piece. Assembly of the adjustable end piece can be varied by varying the assembly of the end piece components and thus varying the length of the end piece. The variation in the length of the end piece allows the end piece to accommodate fasteners of varying lengths.

13 Claims, 6 Drawing Sheets

ADJUSTABLE-LENGTH END PIECE FOR A FASTENER DRIVE TOOL

RELATED APPLICATIONS

This application is a continuation-in-part of the following pending U.S. patent applications:

1) U.S. patent application Ser. No. 09/680,761, filed Oct. 6, 2000, now U.S. Pat. No. 6,296,064, claiming the benefit of U.S. Provisional Application Serial No. 60/173,347, filed Dec. 28, 1999; and
2) U.S. patent application Ser. No. 09/815,809, filed Mar. 23, 2001, pending, claiming the benefit of U.S. Provisional Application Serial No. 60/192,866, filed Mar. 29, 2000.

BACKGROUND OF THE INVENTION

This invention generally relates to end pieces to be used in connection with tools for delivering fasteners to a work piece, and more specifically relates to an end piece which can be used with fasteners of different lengths.

The end piece of the present invention can be used with a drive tool for driving fasteners into a workpiece. For example, the end piece of the present invention can be used with either of the drive tools described in U.S. patent application Ser. No. 09/680,761 or U.S. patent application Ser. No. 09/815,809 both of which are incorporated herein in their entirety by reference. The drive tool shown in FIG. 1 relates to U.S. patent application Ser. No. 09/815,809 and is an example of the drive tool in which the end piece of the present invention can be used. The drive tool 10 is configured to allow the operator to install a fasteners into a workpiece while he remains standing. The drive tool 10 includes a central housing 11, a funnel structure 12 located proximate to the central housing 11 and an end piece 14 mounted at the distal end of the central housing 11. When operating the drive tool 10, fasteners are loaded into the funnel structure 12 and are delivered to the end piece 14 one at a time. An aperture 16 is provided at the distal end of the end piece 14. The fasteners are delivered from the end piece 14 to the work piece through the aperture 16. As shown in FIG. 2, the end piece 14 includes a side wall 18, a central passageway 20 defined by the side wall 18 and an aperture 22 through the side wall 18. When the drive tool is in operation, fasteners travel to the end piece 14 through the aperture 22 in the side wall 18, through the central passageway 20 and exit the end piece 14 through the aperture 16 at the distal end of the end piece 14.

Fasteners used in connection with the drive tools will vary in length depending upon the application for which the fastener is used. The end piece must be of an appropriate length to accommodate the fastener to be installed. Each end piece provided with the drive tools of the prior art are designed to accommodate fasteners within a relatively small range of lengths, generally one inch. If the operator desires to install fasteners of a greater or smaller length than the range allowed by the end piece currently mounted to the drive tool, a different end piece must be mounted onto the tool. Thus, in the past, multiple end pieces were provided for each drive tool to accommodate the varying length of fasteners. For example, a drive tool may include a set of three end pieces of varying lengths which can accommodate fasteners of the most common lengths. The end pieces are generally formed from steel and are relatively heavy.

One disadvantage of supplying multiple end pieces with each drive tool is that each additional end piece increases the overall weight of the drive tool and its components. The increased weight makes the drive tool and its components more difficult to transport and increases shipping costs.

Another disadvantage of providing multiple end pieces is that additional material and manufacturing costs are incurred. Not only does the manufacture of each end piece require the supply of additional steel, but each manufacturing step to form the end piece (e.g. machining, drilling etc.) adds to the production cost of each end piece.

During use, the end piece of a drive tool is generally subjected to substantial forces. Still another disadvantage of providing multiple end pieces of different lengths is that if a portion of a particular sized end piece becomes worn or damaged, the entire end piece must be replaced. Until the end piece is replaced, the drive tool cannot be used to drive that respective sized fastener.

An embodiment of the present invention provides an improved end piece which is directed to overcome at least some of the problems presented in the prior art.

OBJECTS AND SUMMARY OF THE INVENTION

A general object of an embodiment of the present invention is to provide an end piece which can accommodate fasteners of varying lengths.

An object of an embodiment of the present invention is to provide an end piece which has a length that can be varied easily.

Yet another object of an embodiment of the present invention is to provide an end piece which eliminates the need to supply multiple end pieces with a given drive tool in order to provide that the drive tool can be used to drive various length fasteners into a work piece.

Still another object of an embodiment the present invention is to provide a single end piece which can accommodate various length fasteners thereby reducing the overall weight of the end pieces which must be supplied with a drive tool.

Still yet another object of the present invention is to provide an end piece which consists of a plurality of replaceable components.

Briefly, and in accordance with at least one of the foregoing objects, an embodiment of the present invention provides an improved end piece for a drive tool which delivers fasteners to a work piece. The end piece includes an upper end piece and a lower end piece. By inserting a spacer between the upper and lower end pieces, the length of the end piece can be adjusted to accommodate fasteners of varying lengths. The spacer can include one or more spacer components to allow for an even greater variety of end piece lengths. Portions of the upper end piece, spacer components and lower end piece are threaded to allow for easy adjustment of the end piece's length.

By varying the length of the end piece, multiple end pieces are no longer needed to install varying length fasteners. Preferably, the cost of manufacturing one adjustable length end piece is less than the cost of manufacturing multiple end pieces of varying lengths. In addition, preferably the weight of a single adjustable length end piece is less than the weight of multiple end pieces of varying lengths. Finally, the end piece is preferably comprised of a plurality of replaceable components such that if a component becomes damaged or worn, the individual component can be replaced rather than replacing the entire end piece. Additionally, depending on which component has become damaged or worn, the remainder of the end piece components may be useable until the damaged component is replaced.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
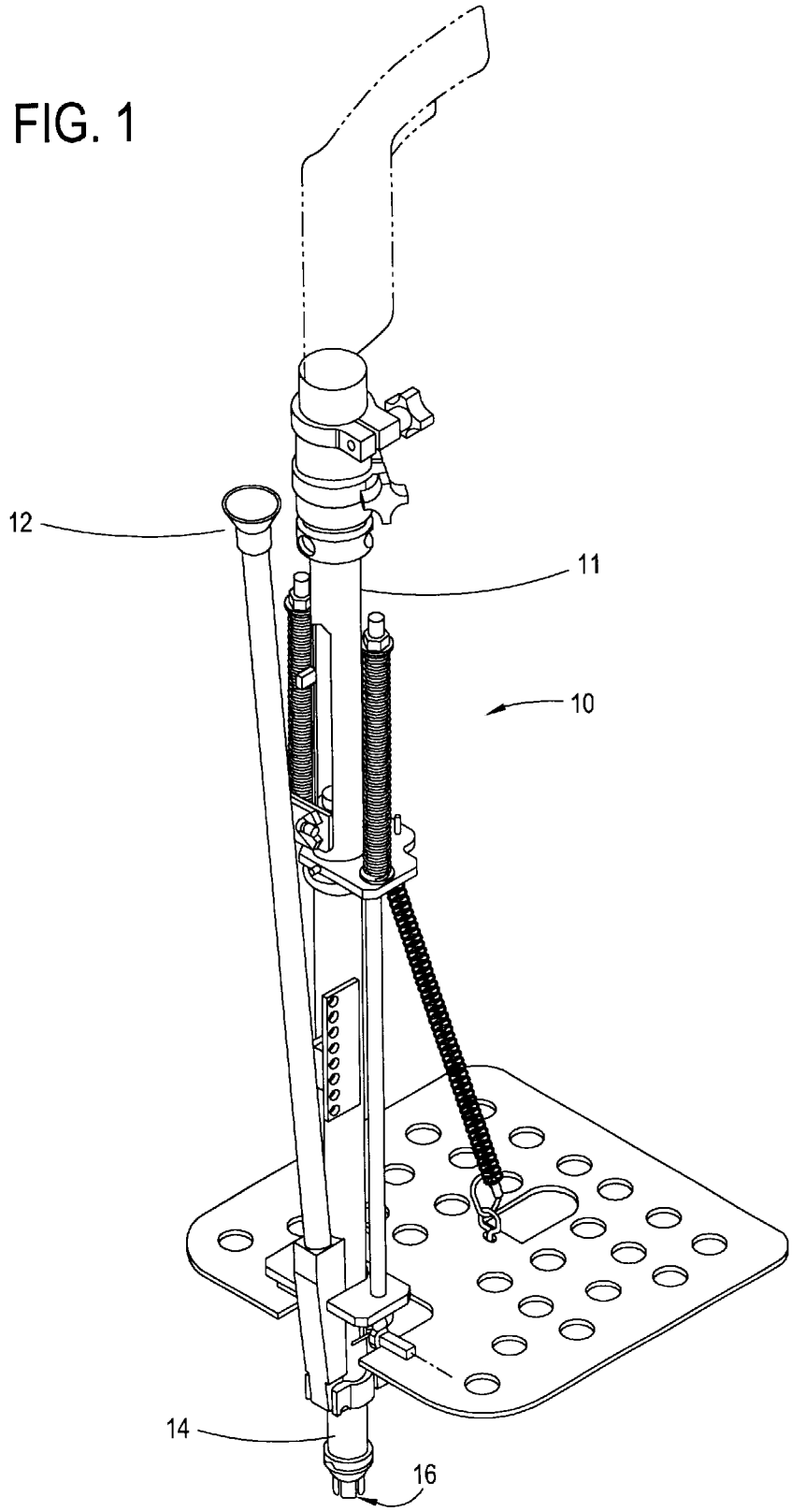
FIG. 1 is a perspective view of a drive tool that uses an end piece for delivering fasteners to a work piece.
Figure 2:
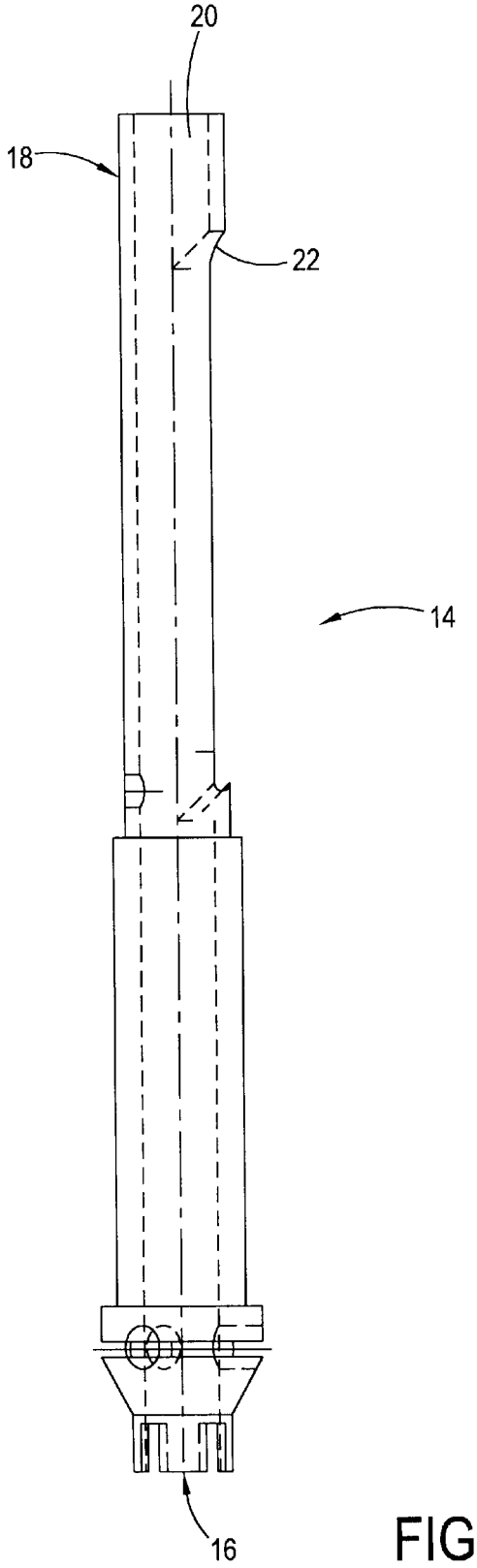
FIG. 2 is a side view of the end piece component of the drive tool shown in FIG. 1, wherein the end piece is provided as a single piece.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 3:
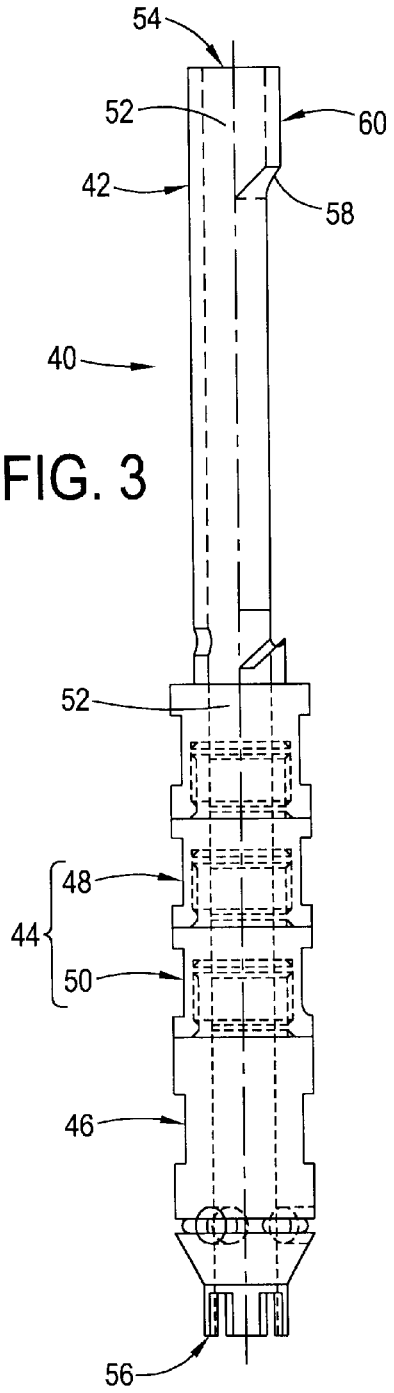
FIG. 3 is a side view of an end piece which is in accordance with an embodiment of the present invention, showing two spacer components employed between an upper and lower end piece.

Shown in FIG. 3 is an end piece 40 which is in accordance with an embodiment of the present invention. The length of the end piece 40 can be easily varied to accommodate fasteners of varying lengths. Therefore, there is no need to supply multiple end pieces with the drive tool. Thus, the overall weight of the end piece components provided with the drive tool is reduced. Additionally, should a particular component become damaged, the component can be replaced without requiring replacement of the entire end piece.

The end piece 40 is configured for use in connection with a drive tool such as the drive tool 10 shown in FIG. 1. As shown in FIG. 3, the end piece 40 includes an upper end piece 42, a spacer 44, and a lower end piece 46. The spacer 44 includes a first spacer component 48 and a second spacer component 50. A central through bore extends through each of the components such that when the components are engaged with each other as shown in FIG. 3, a central internal longitudinal passageway 52 extends from a proximal end 54 of the end piece 40 to the distal end 56 of the end piece 40.

Figure 4:
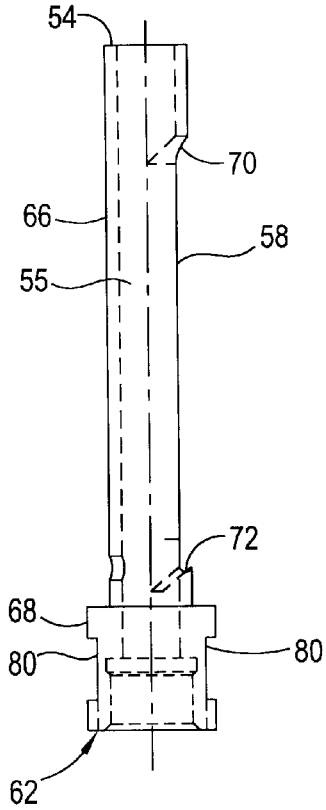
FIG. 4 is a side view of the upper end piece component of the end piece shown in FIG. 3.
Figure 5:
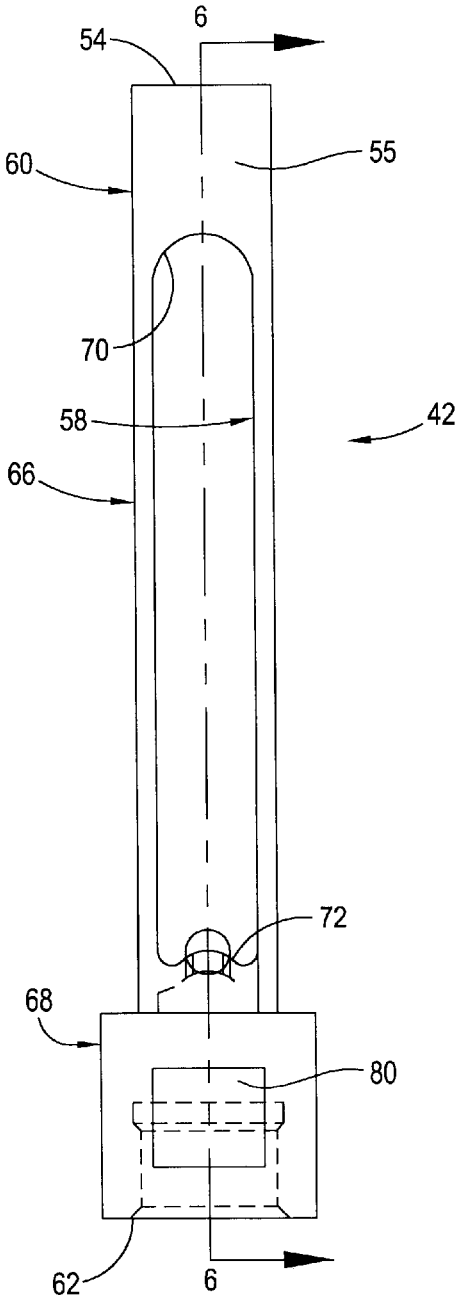
FIG. 5 is another side view of the upper end piece component of the end piece shown in FIG. 3.
Figure 6:
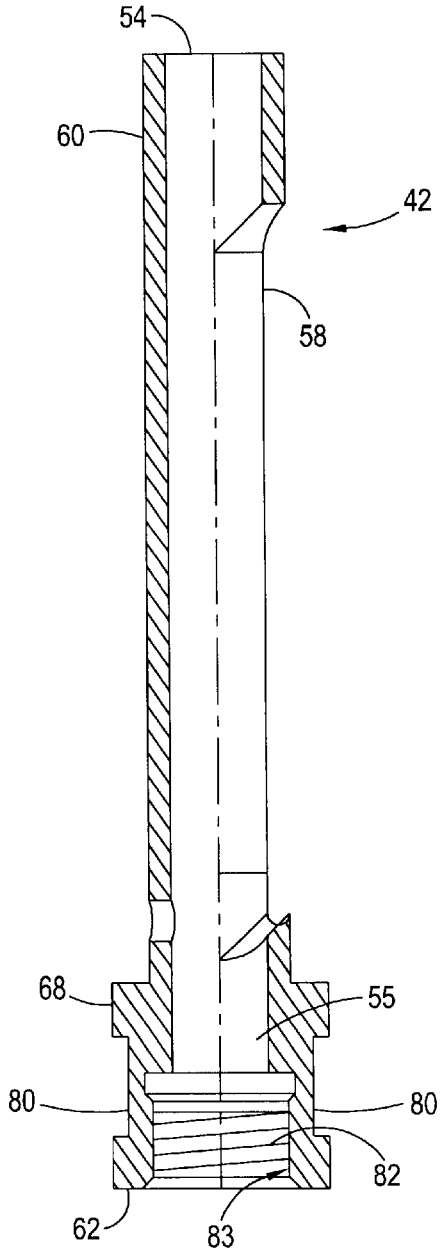
FIG. 6 is a cross-sectional view of the upper end piece, taken along line 6—6 of FIG. 5.

The upper end piece 42 is shown isolated in FIGS. 4–6. The upper end piece 42 is generally cylindrical with a central through bore 55 extending from the proximal end 54 of the upper end piece 42 to the distal end 62 of the upper end piece 42. A first portion 66 of the upper end piece 42 has a smaller diameter than the second portion 68 of the upper end piece 42. An aperture 58 is provided through the side wall 60 in the first portion 66. As shown in FIG. 5, the aperture 58 is generally rectangular with an outwardly curved end 70 and an inwardly curved end 72.

Wrench flats 80 are located on the outer surface of the second portion 68. The wrench flats 80 assist the user in assembly and disassembly of the end piece 40. As shown in FIG. 6, threads 82 are provided on the interior surface 83 of the second portion 68. The threads 82 provide means for connecting the upper end piece 42 to the first spacer component 48.

Figure 7:
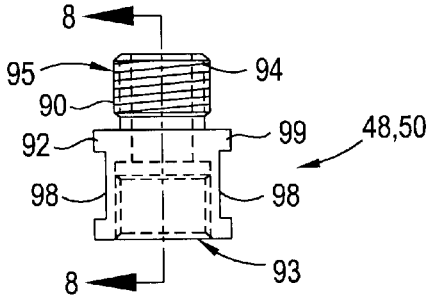
FIG. 7 is a side view of either one of the spacer components shown in FIG. 3.
Figure 8:
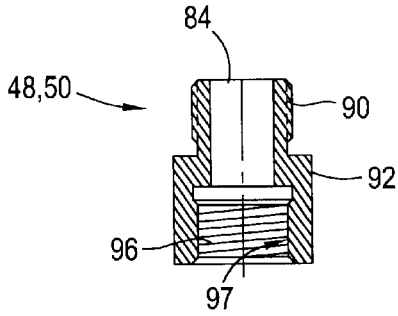
FIG. 8 is a cross-sectional view of the spacer component shown in FIG. 7, taken along line 8—8 of FIG. 7.

The spacer components 48 and 50 are preferably identically constructed as shown in FIGS. 7 and 8. The spacer components 48, 50 are generally cylindrically shaped with a central through bore 84. A first portion 90 is smaller in diameter than a second portion 92. Threads 94 are provided on the exterior surface 95 of the first portion 90. Threads 96 are also provided on the interior surface 97 of the second portion 92. The threads 94 on the first portion 90 of each spacer component 48, 50 are configured to be engaged with the threads 82 on the upper end piece 42 as well as the threads 96 on the other spacer component 48, 50. Hence, the spacer components 48, 50 are interchangeable. As shown, wrench flats 98 are provided on the exterior surface 99 of the second portion 92. The wrench flats 98 can be used to grasp the spacer component 48, 50 when engaging the spacer component 48, 50 with another component.

Figure 9:
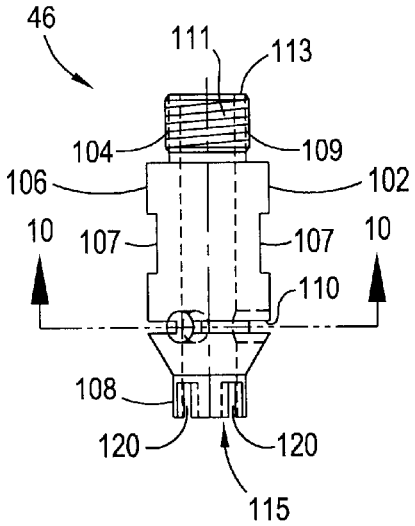
FIG. 9 is a side view of the lower end piece component of the end piece shown in FIG. 3.
Figure 10:
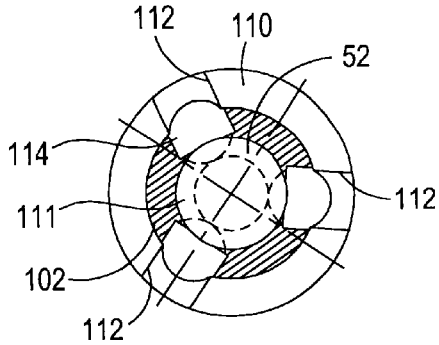
FIG. 10 is a cross-sectional view of the lower end piece, taken along line 10—10 of FIG. 9.

The lower end piece 46 is shown isolated in FIGS. 9 and 10. The lower end piece 46 is comprised of a generally cylindrically shaped side wall 102. The side wall 102 has a first portion 104, a second portion 106 and a third portion 108. The outer diameter of the first portion 104 is generally smaller than the outer diameter of the second portion 106. The outer diameter of the third portion 108 is also smaller than the outer diameter of the second portion 106. A central through bore 111 extends from the proximal end 113 of the lower end piece 46 to the distal end 115 of the lower end piece 46.

Threads 109 are located on the outer surface of the first portion 104 and the threads 109 are configured to engage the threads 96 on either one of the spacer components 48, 50 as well as the threads 82 on the upper end piece 42.

Flats 107 are located on the outer surface of the second portion 106. The flats 107 can be used to grasp the lower end piece 46 when threading the lower end piece 46 to the spacer component 48, 50. A retaining ring recess 110 is provided around the circumference of the wall 102 on the outer surface thereof. Below the retaining ring recess 110, the exterior surface of the wall 102 is tapered such that the circumference of the second portion 106 is smaller at its distal end than at its proximal end. As shown in FIG. 10, three retaining ball apertures 112 are provided through the wall 102 and extend from the outer surface of the wall 102 to the central through bore 111 of the lower end piece 46.

The retaining ball apertures 112 are equally spaced around the circumference of the lower end piece 46 and the retaining ring recess 110 is in communication with each of the retaining ball apertures 112. A retaining ball 114 is positioned in each retaining ball aperture 112. A retaining ring (not shown) is seated in the retaining ring recess 110 to maintain the retaining balls 114 within the retaining ball apertures 112. The retaining ring is preferably generally constructed of flexible material such as rubber or silicone and can, for example, comprise an o-ring. The fastener used in connection with the end piece may be a self-drilling fastener, such as a fastener consistent with that which is shown and described in U.S. Pat. No. 5,605,423, which is incorporated herein in its entirety by reference. The fastener includes a flange which extends radially outward from the body of the fastener. As a fastener passes through the central bore 111, the flange on the fastener will rest on the retaining balls 114 to prevent the fastener from prematurely exiting the end piece 40. This allows the drive tool to be moved from one position to the next without the fasteners falling out of the end piece 40. When installing the fastener in the work piece, as the fastener is forced downward within the through bore 111 in the lower end piece 46, the flange on the fastener will force the retaining balls 114 outward allowing the fastener to move distally of the retaining balls 114 and the fastener will exit the end piece 40. Once the flange of the fastener has passed the retaining balls 114, the retaining ring will again force the retaining balls 114 inward where the balls 114 will be positioned to retain the next fastener.

As shown in FIGS. 3 and 9, four chip relief slots 120 are preferably provided in the side wall 102 of the third portion 108 of the lower end piece 46. The chip relief slots 120 allow chips or debris from the work piece which are produced as a result of the installation of the fastener to escape from the end piece 40.

To assemble the end piece 40 shown in FIG. 3, the first portion 90 of the first spacer component 48 (or second spacer component 50 as they are interchangeable) is inserted through the distal end 62 of the upper end piece 42 and the threads 94 on the spacer component 48 are engaged with the threads 82 of the upper end piece 42. Next, the first portion 90 of the second spacer component 50 (or first spacer component 48 as they are interchangeable) is inserted through the distal end 93 of the first spacer component 48 and the threads 94 of the second spacer component 50 are engaged with the threads 96 of the first spacer component 48. Finally, the first portion 104 of the lower end piece 46 is inserted into the distal end 93 of the second spacer component 50 and the threads 109 on the lower end piece 46 are engaged with the threads 96 of the second spacer component 50. The threaded engagements can be further tightened using the wrench flats 80, 98, 107 on each of the components.

Figure 11:
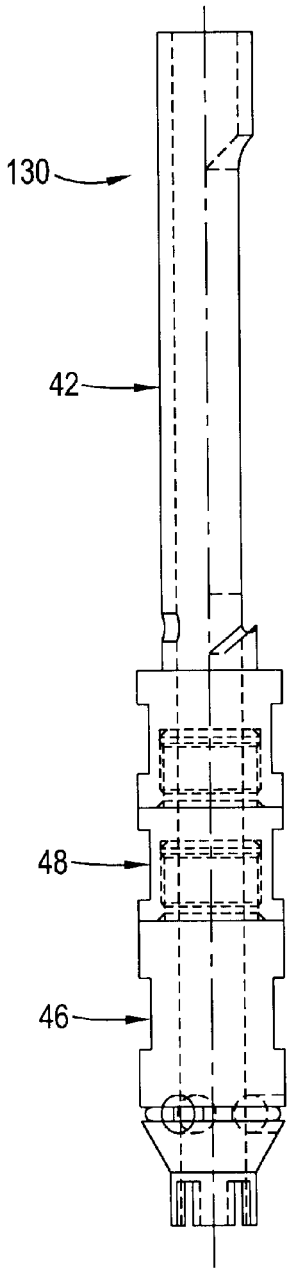
FIG. 11 is a view similar to FIG. 3, but showing only one spacer component employed between the upper and lower end pieces, so that a different length fastener can be accommodated by the end piece.

Assembly of the end piece components (upper end piece 42, first spacer component 48, second spacer component 50 and lower end piece 46) can be varied to accommodate fasteners of different lengths. To install fasteners with shorter lengths the assembly shown in FIG. 11 can be used. As shown in FIG. 11, the end piece 130 includes upper end piece 42, spacer component 48 (or 50), and lower end piece 46. To assemble the end piece 130, spacer component 48 (or 50) is threaded onto the upper end piece 42 and the lower end piece 46 is threaded onto spacer component 48. Flats 80, 98 and 107 can be used to further tighten the threaded connections.

Figure 12:
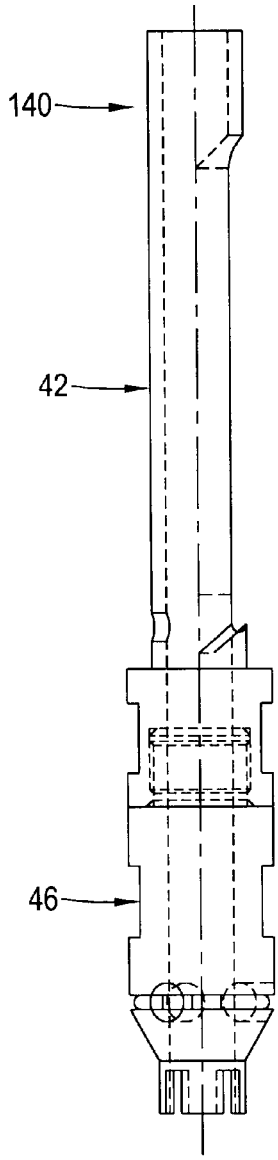
FIG. 12 is a view similar to FIGS. 3 and 11, but showing the upper end piece engaged directly with the lower end piece, and no spacer component employed therebetween, wherein the end piece can accommodate still another length fastener.

To install fasteners with yet shorter lengths the end piece assembly 140 shown in FIG. 12 can be used. As shown in FIG. 12, the end piece 140 includes upper end piece 42 and lower end piece 46, but no spacer components. To assemble the end piece 140, lower end piece 46 is threaded onto upper end piece 42.

By using different combinations of the same end piece components 42, 48, 50, 46, the length of the end piece can be varied. In the preferred embodiment, the components are configured such that the end piece configurations will accept fasteners of the lengths typically used with the drive tool 10. The shortest fasteners are accommodated by assembly of the lower end piece 46 directly with the upper end piece 42. Addition of spacer components 48 and 50 between the upper end piece 42 and the lower end piece 46 will increase the length of the end piece to accommodate longer fasteners. In order to accommodate standard sized fasteners used with drive tools such as the drive tool shown in FIG. 1, in the preferred embodiment the second portion 92 of the spacer components 48, 50 is one inch in length. Therefore, the addition of each spacer component 48, 50 between the upper end piece 42 and the lower end piece 46 lengthens the end piece by one inch. As such, the end piece 40, shown in FIG. 3 (wherein both spacer components 48 and 50 are employed) will accommodate fasteners ranging from 4 inches to 5 inches in length. The end piece 130 shown in FIG. 11 will accommodate fasteners ranging from 3 inches to 4.5 inches in length. Finally, the end piece 140, shown in FIG. 12 will accommodate fasteners ranging from 2 inches to 3 inches in length. It is to be understood, however, that the components 42, 46, 48, 50 can be made of virtually any length to accommodate any range of fastener lengths. It is also to be understood that although assembly of the end piece has been shown with no spacer components, one spacer component and two spacer components, more than two spacer components can be utilized to accommodate fasteners of even greater length. If however, the fastener is too long, the fastener will not pass through the aperture 58 in the upper end piece 42. If very long fasteners are to be installed, the upper end piece 42 can be provided with a longer aperture 58. Alternatively, the fasteners could be fed directly into the passageway 52 from the proximal end 54 of the upper end piece 42. Still other modifications and adaptions can be made depending on the application.

Because the length of the end piece 40, 130, 140 can be adjusted by adding or removing spacer components 48, 50 the end piece 40, 130, 140 can be manipulated to accommodate fasteners of different lengths. Because the end piece 40, 130, 140 can accommodate fasteners of different lengths, there is no need to supply multiple end pieces with a given drive tool. Therefore, the overall weight of the end pieces which must be supplied with a drive tool is reduced. Additionally, if one component of the end piece 40, 130, 140 becomes damaged, only that component must be replaced. Thus, if either or both of the spacers are damaged the upper end piece and the lower end piece can still be used to install fasteners.

While embodiments of the present invention are shown and described, it is envisioned that those skilled in the art may devise various modifications of the present invention without departing from the spirit and scope of the appended claims.

The invention claimed is:

1. An end piece engagable with a drive tool and configured to deliver a fastener from the drive tool to a work piece, said end piece comprising:

an upper end piece engagable with the drive tool and configured to receive the fastener from the drive tool;

a spacer engagable with said upper end piece, and configured to receive the fastener from said upper end piece; and a lower end piece engagable with said spacer and configured to receive the fastener from the spacer; and wherein said spacer is removable from said upper end piece and said lower end piece, and said lower end piece is engagable with said upper end piece thereby altering a length of said end piece.

2. An end piece as recited in claim 1, wherein said spacer comprises a plurality of spacer components engagable with each other, including one spacer component engagable with said upper end piece and another spacer component engagable with said lower end piece.

3. An end piece as recited in claim 2, wherein the length of said end piece is adjustable by varying the number of spacer components disposed between said upper end piece and said lower end piece.

4. An end piece as recited in claim 2, wherein said spacer is configured such that each spacer component disposed between said upper end piece and said lower end piece increases the length of said end piece by one inch.

5. An end piece as recited in claim 1, wherein said end piece is configured to deliver various length fasteners to the work piece by altering the length of said end piece.

6. An end piece as recited in claim 1, wherein said spacer comprises a single spacer component engagable with said upper end piece and said lower end piece.

7. An end piece as recited in claim 6, wherein the length of the fasteners delivered to the work piece varies between 3 inches and 4.5 inches.

8. An end piece as recited in claim 1, wherein said spacer includes a first spacer component and a second spacer component, said first spacer component engagable with said upper end piece and said second spacer component, and said second spacer component engagable with said lower end piece.

9. An end piece as recited in claim 8, wherein said first spacer component is threadedly engagable with said second spacer component.

10. An end piece as recited in claim 8, wherein the length of the fasteners delivered to the work piece varies between 4 inches and 5 inches.

11. An end piece as recited in claim 1, wherein said upper end piece includes a sidewall, a passageway defined by said sidewall, and an aperture through said side wall, wherein the end piece is configured such that the end piece receives the fastener from the drive tool through said aperture and the travels through said passageway toward the work piece.

12. An end piece as recited in claim 11, wherein said upper end piece further includes flats on the outer surface of said sidewall said flats configured to assist a user in engaging and disengaging said upper end piece and said spacer.

13. An end piece as recited in claim 1, wherein said lower end piece further comprises at least one aperture configured to receive a fastener retaining member and

* * * * *

UNITED STATES PATENT AND TRADEMARK OFFICE

CERTIFICATE OF CORRECTION

PATENT NO. : 6,585,141 B2 
DATED : July 1, 2003
INVENTOR(S) : David C. Goss and Jordan Kingsbury It is certified that error appears in the above-identified patent and that said Letters Patent is hereby corrected as shown below:

Column 8,
Line 26, "member and" should be -- member and a recess configured to receive a retaining ring for engaging said fastener retaining member. --

Signed and Sealed this

Eleventh Day of November, 2003

JAMES E. ROGAN
*Director of the United States Patent and Trademark Office*